US005584967A

United States Patent [19]

Grossmann et al.

[11] Patent Number: 5,584,967

[45] Date of Patent: Dec. 17, 1996

[54] TWIN-WIRE SECTION IN A MULTI-PLY FORMER

[75] Inventors: Udo Grossmann, Heidenheim; Konrad Rickelt, Steinheim, both of Germany

[73] Assignee: Voith Sulzer Papiermaschinen GmbH, Heidenheim, Germany

[21] Appl. No.: 378,658

[22] Filed: Jan. 26, 1995

[30] Foreign Application Priority Data

Jan. 27, 1994 [DE] Germany ..... 44 02 274.3

[51] Int. Cl.[6] ..... D21F 11/04

[52] U.S. Cl. ..... 162/304; 162/273; 162/301; 162/303

[58] Field of Search ..... 162/133, 300, 162/301, 303, 304, 273, 274

[56] References Cited

U.S. PATENT DOCUMENTS

| | | | |
|---|---|---|---|
| 3,985,612 | 10/1976 | Watanabe | 162/303 |
| 4,146,424 | 3/1979 | Justus | 162/273 |
| 4,207,144 | 6/1980 | Meinecke et al. | 162/304 |
| 4,532,008 | 7/1985 | Creagan et al. | 162/301 |
| 4,557,802 | 12/1985 | Waris | 162/301 |
| 4,919,760 | 4/1990 | Kerttula | 162/301 |
| 4,988,408 | 1/1991 | Evalahti | 162/301 |
| 5,045,153 | 9/1991 | Sollinger et al. | 162/301 |
| 5,215,628 | 1/1993 | Koivuranta et al. | 162/300 |

FOREIGN PATENT DOCUMENTS

| | | | |
|---|---|---|---|
| 3532458 | 3/1986 | Germany | D21F 1/06 |
| 4031038 | 4/1992 | Germany | D21F 11/04 |

*Primary Examiner*—Karen M. Hastings
*Attorney, Agent, or Firm*—Baker & Daniels

[57] ABSTRACT

A twin-wire section with a first and a second endless wire, for forming a fiber material web of a fiber suspension, notably for forming a ply of a multiply paper or cardboard web, the ply being merged on a third wire with a further ply. In the twin-wire zone formed by the first and second wires, a dewatering box (touching the one wire) that features rigid slats is contained in the loop of the one wire, while in the loop of the other wire there are contained several backing slats which can be pushed flexibly on the other wire, while a loop of one of the two wires contains a forming roll which together with said wire forms a looping zone. The forming roll has a smooth, continuous roll shell. The wire which in the looping zone is outside separates from the web and the inner wire at a distance before the end of the looping zone.

19 Claims, 3 Drawing Sheets

TWIN-WIRE SECTION IN A MULTI-PLY FORMER

BACKGROUND OF THE INVENTION

The invention concerns a twin-wire section for forming a ply of a multiply web of paper or cardboard.

German patent disclosure DE 40 31 038 A1 illustrates a twin-wire former having a twin-wire zone beginning with a first group of dewatering slats, extending then to a forming roll, with the twin-wire zone running beyond the forming roll and at the end over a suction box, once the two twin wires separate. This embodiment seeks a maximally high web moisture content at departure of the forming roll in order to achieve a high ply bond strength in the multiple web. This involves the risk that with the "jagged waterline" described in the document excessively wet stock suspension may in the peaks proceed up to the couching point and be crushed there.

U.S. Pat. No. 4,207,144 shows and describes the wet section of a paper machine with a headbox, a predewatering section following it and formed by a single wire, and then a twin-wire zone which is formed by the said wire and an outer wire enclosing said zone. This system features scrapers merely in the predewatering zone. But it does not contain any rigid dewatering slats in the one wire loop and no flexible dewatering slats either in the other wire loop.

The problem underlying the present invention is to propose a twin-wire section which avoids the occurrence of such a jagged waterline.

SUMMARY OF THE INVENTION

This problem is solved by the teachings of the present invention. The peaks are more heavily dewatered on the forming roll, that is, a jagged waterline is straightened, and no excessively wet stock suspension proceeds to the couch point.

Further features of the invention include design configurations which result in an appreciable reduction of the overall height and, thus, have a cost-saving effect. Also provided as a further feature of the invention is a radical reduction of the overall length, and a constructionally favorable arrangement within the building, in which arrangement the bottom wire is located in a basement and the pick-up point scarcely above the paper machine bottom.

Advantages of the invention are that the twin-wire zone ends directly on the forming roll, and not at a distance thereafter, since the outer wire runs off the forming roll before the inner wire does. With the forming roll smooth, and not open, the web continues on reliably with the inner wire. The risk of damage to the web due to a minimal speed difference between the two wires is thus reduced with this configuration, because the wires separate before, due to tension differences between the two wires, a shifting sets in between the web and the wires.

BRIEF DESCRIPTION OF THE DRAWINGS

The invention is described in detail with the aid of the following drawings.

DETAILED DESCRIPTION OF THE INVENTION

Figure 1:
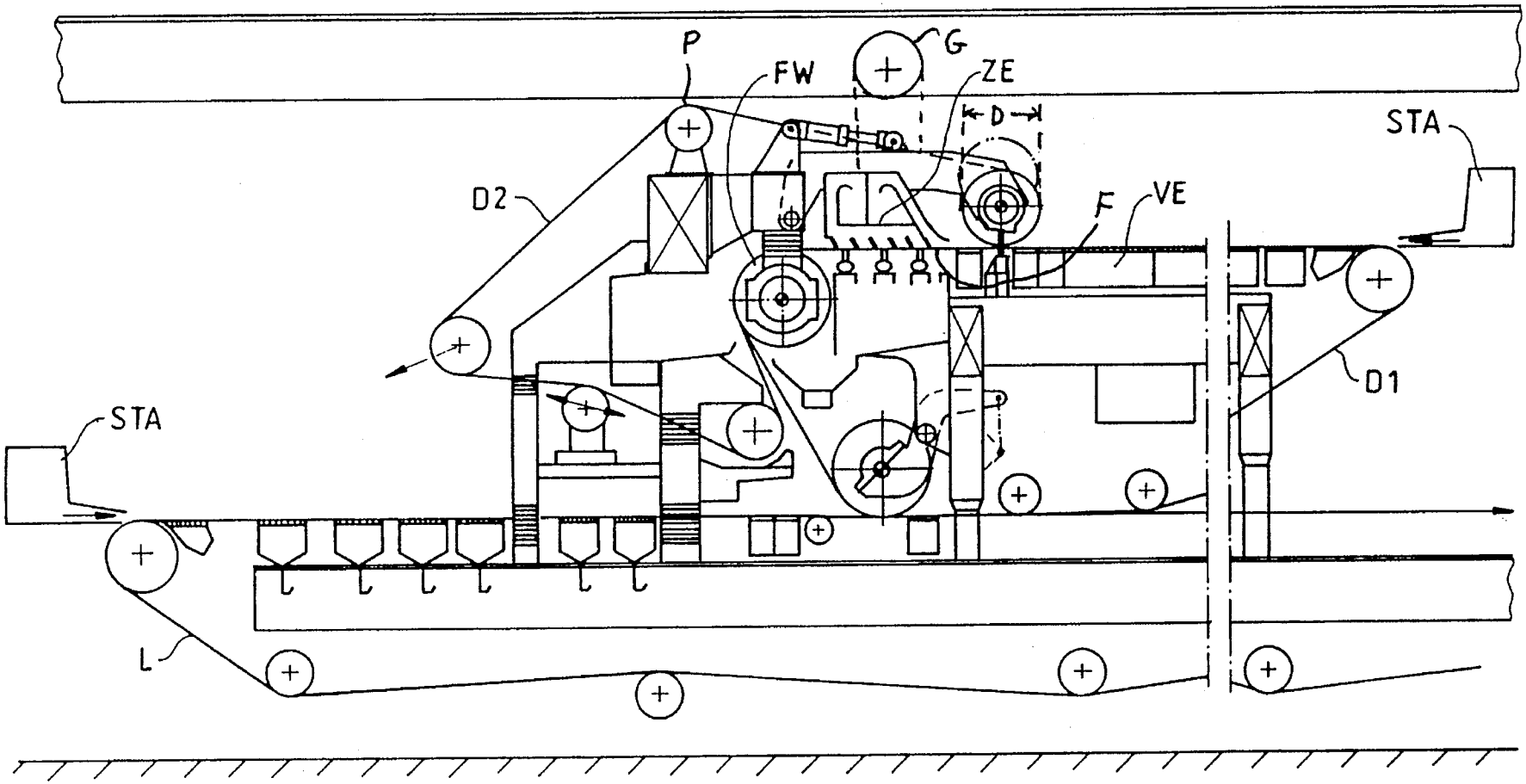
FIG. 1 shows an inventional twin-wire former in conjunction with a fourdrinier machine for the production of a two-ply paper web.

Referring to FIG. 1, illustrated in the lower area is a fourdrinier wire L on which in customary fashion a first ply of paper is created by one-sided dewatering.

Arranged above is a twin-wire former according to the invention, with a first wire D1 and a second wire D2. The first wire D1, on which stock suspension is applied by way of a headbox STA, dewaters the applied stock suspension through a predewatering section VE. Following the latter, the second wire D2 is introduced by means of a pivotable roll. The pivotable roll is supported by pivot arms. The top wire proceeds over the pivotable roll to the twin-wire zone. As shown in the embodiment of FIG. 1, the dewatering box may be secured to the pivot arms and pivot together with the wire roll. Pivot bearings support the pivot arms, which pivot bearings are arranged only a short distance from the forming plane of the bottom wire, and downstream of the dewatering box. Outer ends of the pivot arms support bearings of the suction roll and are supported by either the frame of the bottom wire, or a gantry fitting G over them. The outer ends of the pivot arms rest on a support system which is variable in height. Preferably, the pivot arms have the approximate shape of a lying L, and a pivot axle is situated at the end of the short leg of the "L", and the wire roll bears on the end of the long leg. A lifting system acting essentially in horizontal direction attaches in the area of the center of the long leg. A top wire regulating roll may be arranged below the forming plane of the bottom wire, or alternatively, a top wire tensioning roll may be arranged below the forming plane of the bottom wire. The two wires D1 and D2 then enclose the predewatered stock suspension in sandwich fashion and pass it on to a two-sided dewatering ZE with the aid of dewatering slats which extend across the entire web width. This two-sided dewatering may proceed in any known way. Presently, fixed slats are arranged on the top side, while in their intervening spaces there are dewatering strips provided on the opposite side that allow elastic contact. Following this two-sided dewatering ZE, the paper web contained between the twin wires is passed over the smooth-surface forming roll FW. The wire D2 separates from the paper web, while the wire D1 still is in contact with the forming roll FW, ensuring a reliable dwell of the paper web on the wire D1.

The highest point P of the top wire course is situated by only one to three times the diameter (D) of the wire roll (mounted on the pivot arms) above the forming plane (F) of the bottom wire.

Dewatered in this fashion, the paper ply is by means of the wire D1, via a further roll, overlaid on the ply created on the fourdrinier wire. In the further course, the twin wire then lifts off the two bonded paper plies and returns, whereas the two paper plies remain on the fourdrinier wire and continue on to further processing.

Figure 2:
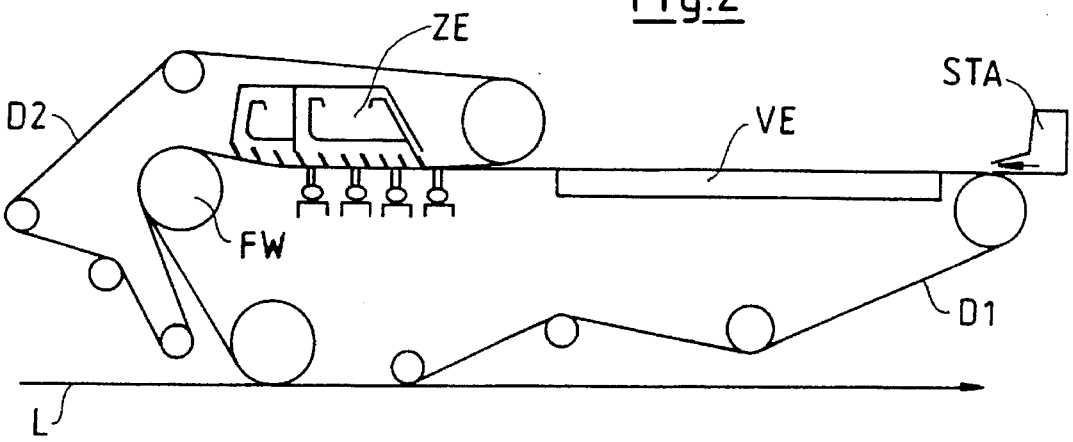
FIGS. 2–6 show alternate embodiments of an inventional twin-wire former.

FIG. 2 shows schematically a configuration similar to FIG. 1, using corresponding references to refer to corresponding elements. The difference between the twin-wire sections of FIG. 1 and FIG. 2 is constituted essentially by the design of the two-sided dewatering ZE. In FIG. 2, the two-sided, level dewatering formed by opposed dewatering slats is followed by a series of fixed dewatering slats arranged in the loop of the wire D2 and imparting to the twin wire a course that curves upward.

Figure 3:
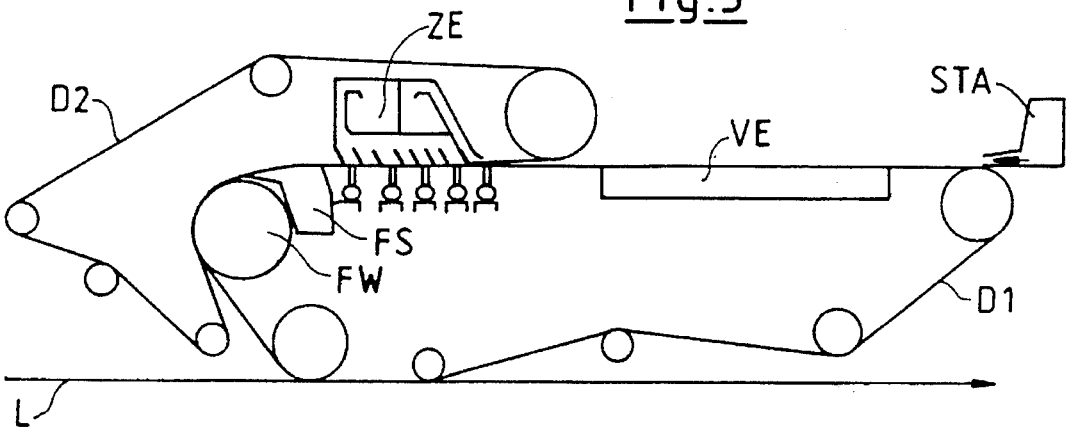

FIG. 3 shows an arrangement similar to that of FIG. 1 and FIG. 2, but with the difference that the level, two-sided dewatering ZE is in the loop of the wire D1 followed by a forming shoe FS with a downward curvature, which shoe then is followed by the forming roll FW.

Figure 4:
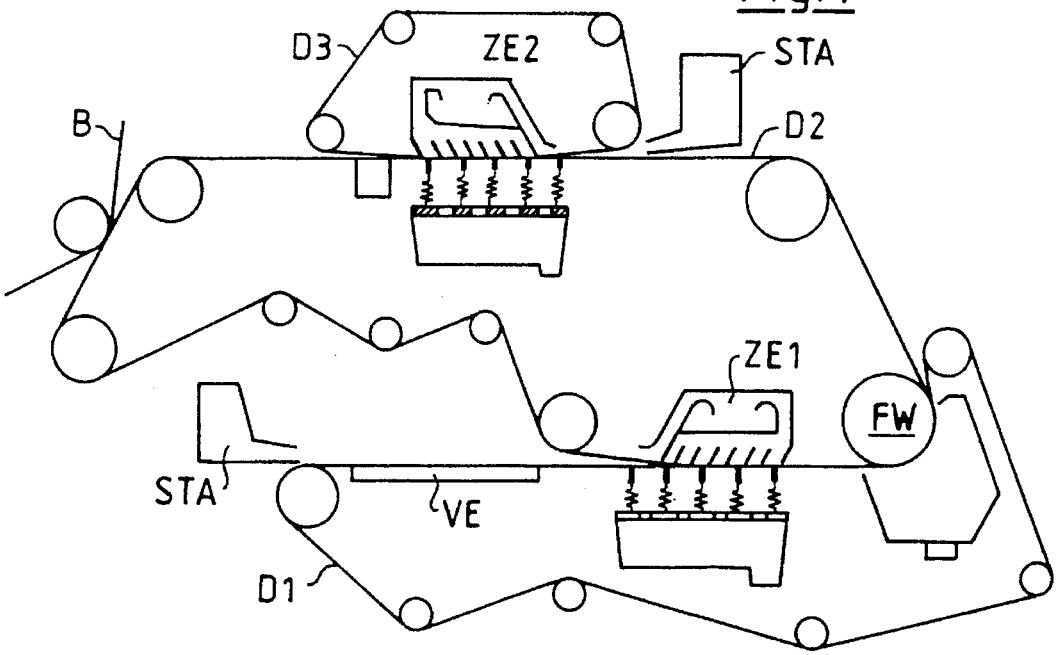

FIG. 4 shows a situation of a wire section which also creates a two-ply paper web by application of stock suspension from a headbox on a first wire D1. A predewatering VE starts with the one-sided dewatering of the first ply. In the further course of wire D1, a second wire D2 is introduced from above, which encloses the newly created first ply in sandwich fashion and passes it on to a two-sided dewatering ZE1. The twin-wire web from D1 and D2 proceeds then to a forming roll with smooth surface FW, the wire D1 then separating in inventional fashion, whereas the wire D2 continues its contact with the surface, so that the paper web continues on along with the wire D2. Wire D2 is then passed, over another idling roll, to a second headbox box, which applies on the already formed web a new stock suspension with direct transfer to a second twin-wire section. Once the dewatering is completed, the two paper plies, lying on the wire D2, proceed then to a transfer point for a continuing belt B.

Figure 5:
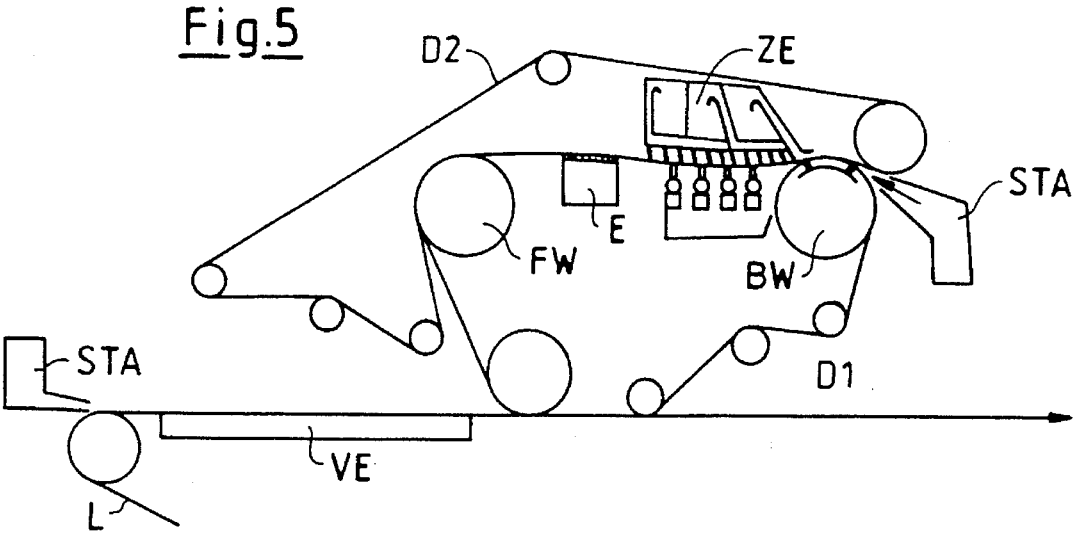

FIG. 5 shows an arrangement similar to that in FIG. 3, but with the curved forming shoe FS of FIG. 3 being in this case replaced by a one-sided dewatering through rigid slats on the dewatering box E, which imparts a straight-line course to the wire. Furthermore, a straight-line predewatering is being waived and the stock suspension, in keeping with a gap former, is introduced directly between the wires D1 and D2, which run over a breast roll.

Figure 6:
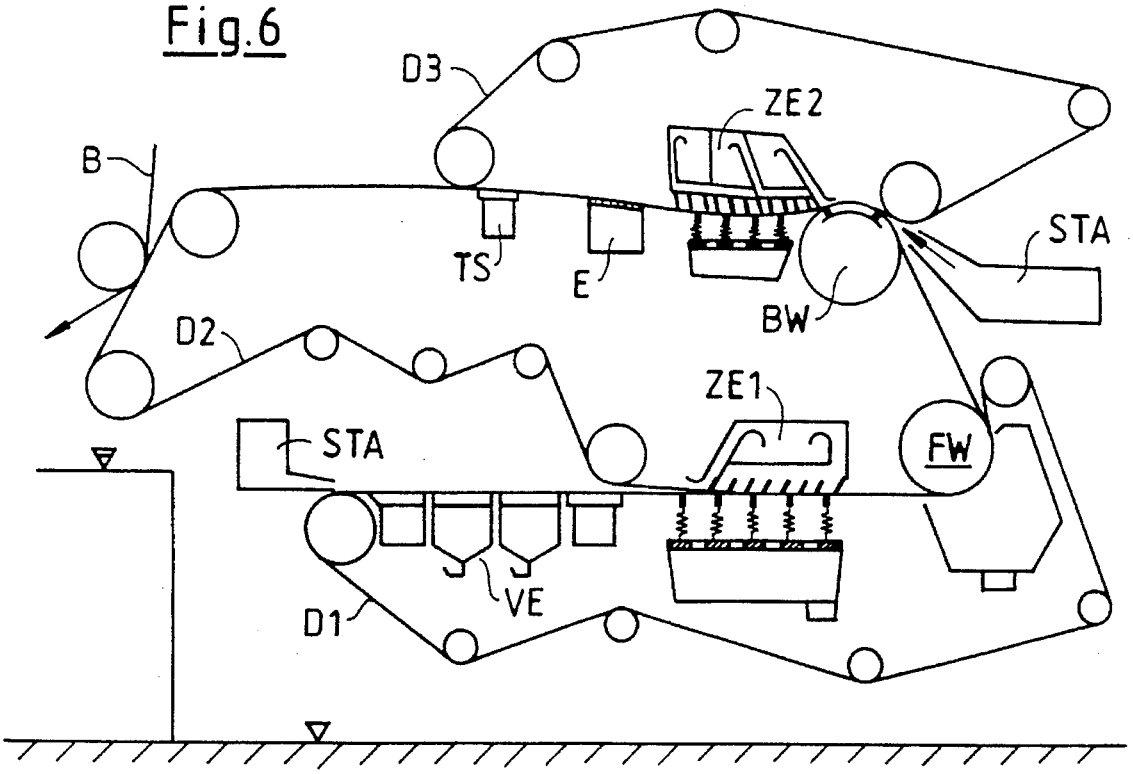

FIG. 6 shows an inventional twin-wire section for the production of a two-ply paper where stock suspension issues onto a first wire D1 and is predewatered by way of a predewatering section VE. Following the predewatering section VE, the wire D1 is then met by a second wire D2 coming from above, so that the two wires D1 and D2 enclose the paper web being created in sandwich fashion. Directly at the merging point of the two wires D1 and D2, a two-sided dewatering ZE1 follows, after which the sandwiched wires are deflected over a forming roll FW. The wire D1 separates from the paper web and the wire D2, while the wire D2 is still in contact with the forming roll FW, so that the paper web remains on the wire D2. Along with the first ply of the paper web lying on it, the wire D2 proceeds to a second twin-wire section, with new stock suspension being introduced via a headbox in a gap which is formed by the wire D2 and a wire D3 coming from above. Provided at the beginning of the gap, which effects a first dewatering of the newly introduced stock suspension, is a breast roll BW in the loop of wire D2. The breast roll BW may be fashioned for suction. After the breast roll, the newly formed twin wire, of D2 and D3, continues to a two-sided dewatering ZE2, with the dewatering slats in the wire loop D2 being in exemplary fashion elastically pushed down on the wire D2, whereas the dewatering slats arranged in the wire D3 are fixed. Following the two-sided dewatering ZE2, the twin wire passes over a dewatering box E with fixed dewatering slats, within wire loop D2, and passes thereafter across a suction separator TS that enables a nonproblematic separation of the wire D3 from the wire D2 and the paper web carried on it. The wire D2 carries the paper web then on to a transfer point from which the paper web is with the aid of a belt B passed to further processing.

What is claimed is:

1. In a multiply former, a twin-wire section for forming a fiber material web from a fiber suspension which forms a ply of a multiply or multilayer paper or cardboard web, which ply is merged on a third wire with a further ply, said twin-wire section comprising:

first and second wires, said first and second wires defining respective first and second loops and a common run of said first and second wires;

a dewatering box positioned within the loop defined by one of said wires, said dewatering box including fixed slats bearing on said one wire in the common run;

a plurality of backing slats positioned within the loop of the other of said wires in the common run, said backing slats being flexibly urgeable against the wire defining said other loop; and a forming roll positioned within a selected one of said loops, said forming roll together with said wire defining said selected loop defining a looping zone having an end, said forming roll having a smooth, continuous roll shell, wherein the wire outside the looping zone separates from the web and the wire inside the looping zone at a distance before the end of the looping zone; and said forming roll being the only roll located downstream of the backing slats in the common run of said first and second wires.

2. The multiply former of claim 1, wherein said twin wire section further includes a gap former.

3. The multiply former of claim 1, wherein said twin wire section further comprises a hybrid former wherein a bottom one of said wires comprises a long wire, and a top one of said wires comprises a short wire.

4. The multiply former of claim 3, further comprising a pivotable roll supported by pivot arms, wherein the top wire proceeds over said pivotable roll supported by pivot arms to the twin-wire zone; said dewatering box being secured to the pivot arms and pivotable together with the pivotable roll.

5. The multiply former of claim 4, further comprising pivotal bearings supporting said pivot arms, said pivotal bearings being positioned in closely spaced relationship to a forming plane of the bottom wire and downstream of the dewatering box; outer ends of the pivot arms support bearings of the pivotable roll and are supported by either a frame of the bottom wire, or a gantry fitting over them.

6. The multiply former of claim 5, wherein said outer ends of the pivot arms rest on a support system which is variable in height.

7. The multiply former of claim 5, wherein the pivot arms have approximately the shape of a lying L.

8. The multiply former of claim 7, wherein a pivot axle is situated at the end of the short leg of the lying L, and the pivotable roll bears on the end of the long leg of the lying L.

9. The multiply former of claim 7, wherein a lifting system acting substantially in horizontal direction attaches about at the center of the long leg.

10. The multiply former of claim 3, wherein a top wire regulating roll is arranged below a forming plane of the bottom wire.

11. The multiply former of claim 3, wherein a top wire tensioning roll is arranged below a forming plane of the bottom wire.

12. The multiply former of claim 3, wherein a highest point of a looping course traveled by the top wire is situated by one to three times the diameter of the pivotable roll mounted on the pivot arms above a forming plane of the bottom wire.

13. The multiply former of claim 1, wherein the first and second wires run along at least substantially straight stretches from the area of said backing slats to the forming roll.

14. The multiply former of claim 3, wherein the wires run to the forming roll over an additional dewatering box which crowns downward and is situated in the top wire.

15. The multiply former of claim 3, wherein the first and second wires run to the forming roll over an additional dewatering box that has an upward curvature and is contained in the bottom wire.

16. The multiply former of claim 1, wherein the wires run off the forming roll in downward direction.

17. The multiply former of claim 1, wherein the wires run off the forming roll in upward direction.

18. In a twin-wire section formed by a first and a second endless wire for forming a fiber material web of a fiber suspension, wherein a ply of a multiply or multilayer paper or cardboard web is formed, the ply being merged on a third wire with a further ply, the first and second endless wires comprising first and second respective loops and a common run of said first and second wires, and wherein a dewatering box positioned in the loop of one of said wires and bearing on said one wire in the common run includes rigid slats, and wherein a plurality of backing slats are positioned in the loop of the other wire, said backing slats being flexibly urged on said other wire in the common run, wherein a forming roll is positioned in one of said first and second loops, said forming roll together with said loop forming a looping zone, the improvement comprising:

the forming roll has a smooth, continuous roll shell; and the wire which is outside of the looping zone separates from the web and the inner wire at a distance before the end of the looping zone; and said forming roll being the only roll located downstream of the backing slats in the common run of said first and second wires.

19. The twin-wire section of claim 18, wherein the inner wire in the looping zone of the forming roll forms above the forming roll a second twin-wire zone with the third wire, in that in an entry gore for said second twin-wire zone an additional headbox is arranged, and in that the said inner wire carries the web to a pick-up point.

* * * * *